United States Patent [19]

Dines et al.

[11] Patent Number: 4,694,754

[45] Date of Patent: Sep. 22, 1987

[54] MULTI-PHASE CHARGE HOLDER

[75] Inventors: Jack E. Dines; Ernest L. Gillingham, both of Fort Worth, Tex.

[73] Assignee: Jet Research Inc., Arlington, Tex.

[21] Appl. No.: 854,277

[22] Filed: Apr. 21, 1986

[51] Int. Cl.[4] ..... F42B 1/02

[52] U.S. Cl. ..... 102/310; 102/320; 102/321; 102/333

[58] Field of Search ..... 102/312, 313, 310, 320, 102/321, 333; 175/4.6

[56] References Cited

U.S. PATENT DOCUMENTS

| | | | |
|---|---|---|---|
| 2,750,884 | 6/1956 | Gaines | 102/20 |
| 2,756,677 | 7/1956 | McCullough | 102/20 |
| 2,799,224 | 7/1957 | Long | 102/20 |
| 2,981,185 | 4/1961 | Caldwell | 102/20 |
| 3,048,101 | 8/1962 | Lebourg | 102/20 |
| 3,078,797 | 2/1963 | Blair | 102/20 |
| 3,094,930 | 6/1963 | Blair | 102/20 |
| 3,636,875 | 1/1972 | Dodson | 102/20 |
| 4,071,096 | 1/1978 | Dines | 175/4.6 |
| 4,313,380 | 2/1982 | Martner et al. | 102/320 X |
| 4,326,462 | 4/1982 | Garcia et al. | 102/310 |
| 4,598,775 | 7/1986 | Vann et al. | 102/321 X |
| 4,635,734 | 1/1987 | Donovan et al. | 102/312 X |

*Primary Examiner*—Peter A. Nelson

*Attorney, Agent, or Firm*—James R. Duzan; Joseph A. Walkowski; Lucian Wayne Beavers

[57] ABSTRACT

A shaped charge carrier assembly apparatus includes a carrier having a plurality of carrier segments integrally formed from a single substantially flat elongated sheet of structural material. An interconnecting portion is located between each two adjacent segments and is integrally connected therewith. The interconnecting portion provides a rigid and precise angular offset between adjacent segments through a permanent deformation of the interconnecting portion. Each carrier segment has a charge receiving opening therein and includes a pair of diametrically opposed wedges for snugly enaging a pair of elastomeric lugs of a shaped charge.

18 Claims, 10 Drawing Figures

MULTI-PHASE CHARGE HOLDER

BACKGROUND OF THE INVENTION

1. Field Of The Invention

The invention relates to a shaped charge carrier assembly of the type used to perforate an oil or gas well. The invention particularly pertains to the construction of a strip type carrier providing an angular offset between adjacent charges, and to the construction of a carrier opening and associated shaped charge to provide for an interlocking engagement of the charge with the opening.

2. Description Of The Prior Art

Perforating guns commonly used in wire line service operations for perforating an oil or gas well typically include a carrier having a plurality of shaped charges attached thereto with a detonating cord assembled with the carrier and engaged with the shaped charges for detonating them. This assembly may be housed in a hollow cylindrical housing, or in some cases, the carrier assembly itself is lowered into the well without a protective housing. If a protective housing is not utilized, a dome-shaped cover may be placed over the forward face of the shaped charge to assure that an appropriate minimum standoff distance is maintained between the charge and the wellbore.

The prior art has included a number of strip type carriers wherein the carrier is constructed from sheet metal. Openings are formed through the sheet metal carrier, and the shaped charges are inserted through the openings and attached to the carrier with some form of lug type attachment means or a clip. Examples of such prior art devices are shown in U.S. Pat. No. 3,078,797 to Blair, U.S. Pat. No. 4,326,462 to Garcia et al., U.S. Pat. No. 3,048,101 to LeBourg, U.S. Pat. No. 3,094,930 to Blair and U.S. Pat. No. 2,756,677 to McCullough.

It is also known in the prior art to radially stagger adjacent charges so that an angle of, for example, 45°, 60° or 90° is provided between adjacent charges. Examples of such prior art devices include U.S. Pat. No. 2,756,677 to McCullough mentioned above, and U.S. Pat. No. 2,750,884 to Gaines.

SUMMARY OF THE INVENTION

The shaped charge carrier assembly apparatus of the present invention provides improvements both in the construction of a strip type carrier having a radial offset between adjacent charges, and in the construction of an interlocking arrangement of the opening of the strip type carrier with the shaped charge itself.

The apparatus of the present invention includes a strip type carrier having a plurality of carrier segments integrally formed from a single substantially flat elongated sheet of structural material.

An interconnecting portion of the carrier is located between and integrally connected with each two adjacent carrier segments. This interconnecting portion is defined at least partially by first and second transverse slots extending from opposite edges of the elongated carrier toward a longitudinal central axis thereof.

The adjacent carrier segments are angularly offset from each other about the longitudinal axis by permanent deformation of the interconnecting portion located therebetween. This provides an easily formed, yet rigid structure which can have the desired angular offset easily formed therein.

Each of the carrier segments has a generally circular opening therethrough for receiving one of the shaped charges.

Each shaped charge has a lug means defined thereon. The lug means includes a longitudinal lug portion extending generally parallel to a longitudinal axis of the shaped charge, and a radial lug portion extending radially outward from the longitudinal lug portion.

The generally circular opening of the carrier includes a minimum diameter portion too small to longitudinally receive the lug means of the shaped charge therethrough, and a lug receiving portion for longitudinally receiving the lug means therethrough.

The carrier also includes wedge means extending into the opening adjacent the lug receiving portion of the opening for snugly engaging the longitudinally lug portion of the shaped charge upon rotation of the shaped charge relative to the carrier after longitudinal insertion of the lug means through the lug receiving portion of the opening.

This provides an easily assembled, yet very secure attachment of the shaped charge to the carrier.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 3:
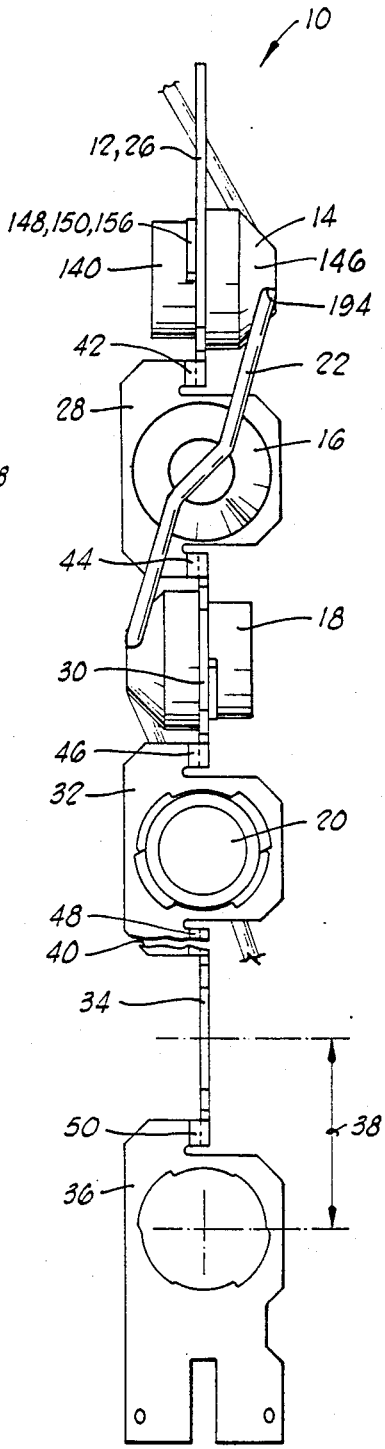
FIG. 3 shows the carrier of FIG. 2 with a plurality of shaped charges and a detonating cord assembled therewith.

Referring now to the drawings, and particualrly to FIG. 3, a shaped charge carrier assembly apparatus of the present invention is shown and generally designated by the numeral 10.

The apparatus 10 includes a carrier 12, a plurality of shaped charges such as 14, 16, 18 and 20, connected to the carrier 12, and a detonating cord 22 connected to each of the shaped charges.

Figure 1:
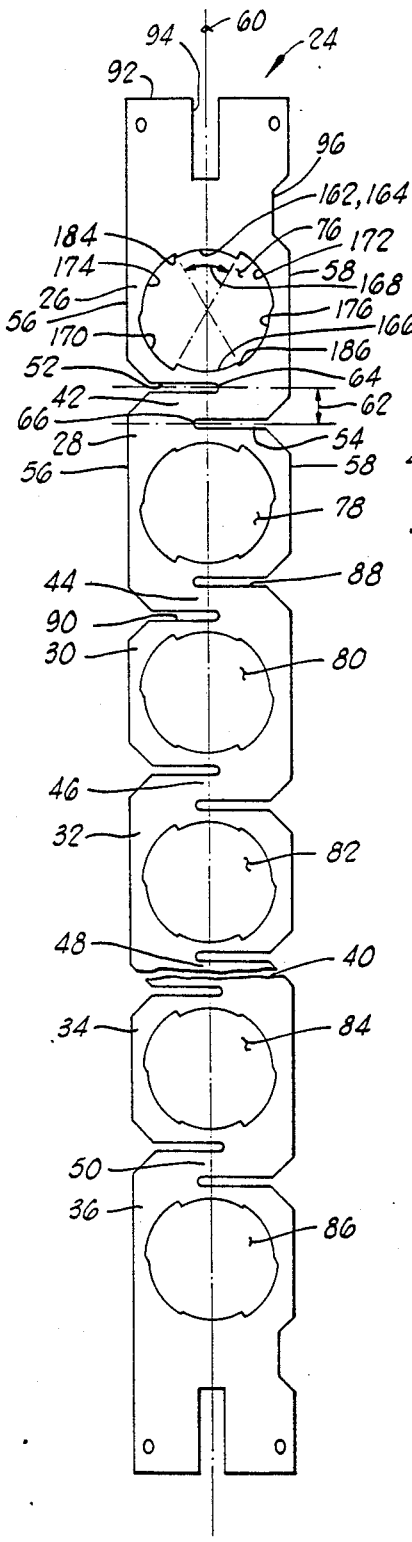
FIG. 1 is an elevation view of an elongated sheet of structural material which has had openings and slots formed therein to define a plurality of carrier segments.
Figure 2:
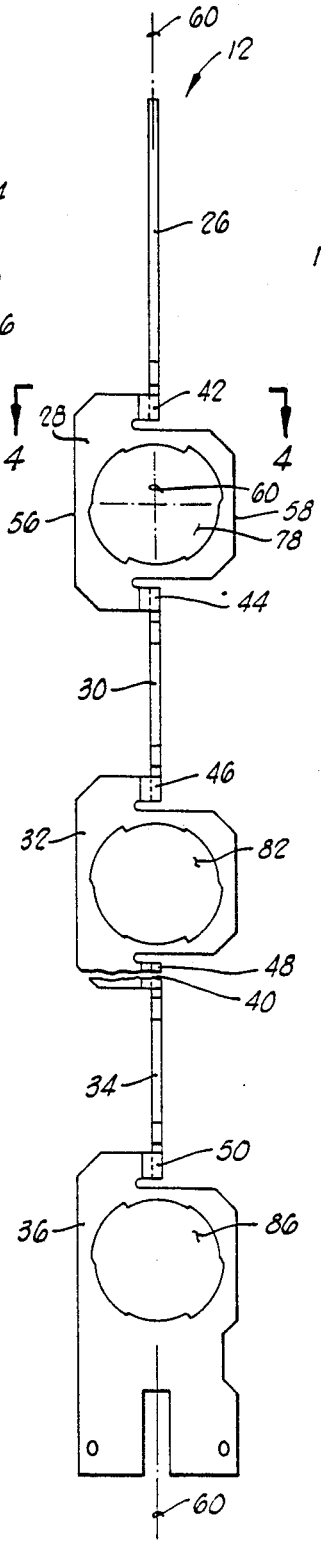
FIG. 2 is an elevation view of a carrier which has been formed from the elongated sheet of structural material seen in FIG. 1.

The carrier 12 is shown along in FIG. 2. The carrier 12 is formed from a single substantially flat elongated sheet of material 24 seen in FIG. 1.

The carrier 12 includes a plurality of carrier segments such as 26, 28, 30, 32, 34 and 36.

The carrier 12 will typically have a length on the order of ten feet, and will have a spacing 38 between adjacent shaped charges on the order of three inches. Accordingly, it will be understood that FIG. 3 shows only a portion of the overall length of the carrier 12 as is indicated by the break line 40.

Two or more carriers like carrier 12, each having a length of approximately ten feet, can be connected together if a longer carrier assembly is needed.

The carrier 12 includes a plurality of interconnecting portions such as 42, 44, 46, 48, and 50. Each of the interconnecting portions 42–50 is located between and is integrally connected with each two adjacent carrier segments. For example, the interconnecting portion 42 is located between and integrally connected with carrier segments 26 and 28. As used herein, the term "integrally connected" means that the two portions of the carrier 12 such as the interconnecting portion 42 and the carrier segment 26 are formed as a unit from the single sheet of structural material 24. They are not attached together by welding, bolting or some other means of connecting separate pieces, but instead they are parts of what was once a homogeneous sheet of structural material.

Each of the interconnecting portions such as 42 is defined at least partially by first and second transverse slots such as 52 and 54, respectively, extending from opposite edges such as 56 and 58, respectively, of the elongated carrier 12 and particularly of the original elongated sheet of material 24 from which the carrier 12 is constructed.

Each of the transverse slots such as 52 and 54 extend from the edges 56 and 58, respectively, toward a longitudinal central axis 60 of the elongated carrier 12.

The carrier 12 of FIGS. 2 and 3 is constructed so that adjacent carrier segments such as 26 and 28 are angularly offset from each other about the longitudinal axis 60 through an angle of substantially 90°. This is accomplished by permanent deformation of the interconnecting portions such as 42 located between adjacent segments such as 26 and 28.

In the embodiment of the carrier 12 shown in FIGS. 1–4, the first and second transverse slots such as 52 and 54 associated with a given one of the interconnecting portions such as 42 are longitudinally spaced from each other by a distance 62 (see FIG. 1). Also, inner ends such as 64 and 66 of the first and second transverse slots 52 and 54, respectively, both extend past the longitudinal center axis 60 of carrier 12 so that the slots 52 and 54 transversely overlap.

The interconnecting portion 42 is defined between the transversely overlapping inner portions of the first and second transverse slots 52 and 54 and lies along the longitudinal central axis 60 of the carrier 12.

Figure 4:
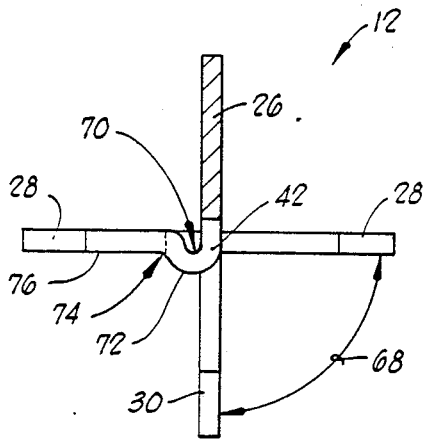
FIG. 4 is a horizontal section view taken along line 4—4 of FIG. 2.

FIG. 4 shows a horizontal section view of the carrier 12 taken along line 4—4 of FIG. 2. The section of FIG. 4 is taken through the same level as the transverse slot 52.

In FIG. 4, the angle 68, which is equal to substantially 90°, between adjacent carrier segments such as 28 and 30 is readily apparent.

Also illustrated in FIG. 4 is the preferred shape of the interconnecting portion 42 between adjacent carrier segments 26 and 28. Preferably, the interconnecting portion 42 has a concave shape as indicated at 70 on the inside of the bend, and a convex shape as indicated at 72 on the outside of the bend, with a relatively sharp edge 74 between the convex-shaped outer bend 72 and a flat vertical surface 76 of carrier segment 28.

As is apparent in FIG. 4, the interconnecting portion 42 is permanently deformed by transversely bending the interconnection portion 42 about a bending axis substantially parallel to the longitudinal central axis 60 of carrier 12.

Referring again to FIG. 1, each of the carrier segments 26–36 includes one and only one charge receiving opening such as 76, 78, 80, 82, 84 and 86 disposed therethrough for receiving one of the shaped charges.

Looking collectively at FIGS. 1 and 2, the manner in which the interconnecting portions 42–50 are deformed to create the carrier 12 in FIG. 2 out of the elongated substantially flat sheet of material 24 in FIG. 1, is apparent. Alternating ones such as 26, 30 and 34 of the carrier segments are rotated 90° about the longitudinal central axis 60 relative to the remaining ones such as 28, 32 and 36 of the carrier segments.

Also, the arrangement of the transverse slots such as 52 and 54 in the elongated strip of material 24 in FIG. 1 should be noted.

Referring for example to carrier segment 28 and the opening 78 disposed therethrough, the arrangement of slots can be described by saying that a longitudinally closest slot 54 of the first and second transverse slots 52 and 54 associated with interconnecting portion 42 located immediately above carrier segment 28, and a longitudinally closest one 88 of first and second transverse slots 88 and 90 associated with interconnecting portion 44 located immediately below carrier segment 28, both extend from a common edge 58 of the elongated carrier 24.

As is apparent in FIG. 3, each of the shaped charges such as 14 is held within its associated opening such as 76 in the carrier 12 so that the shaped charge is directed substantially normal, that is perpendicular to, the plane of its associated flat carrier segment such as 26.

The construction illustrated in FIGS. 1–4 provides interconnecting portions such as 42 between adjacent carrier segments 26 and 28, which interconnecting portion 42 is structurally rigid, so that the 90° angle, such as indicated by the angle 68 in FIG. 4, is maintained with relatively little variation during normal handling of the apparatus 10 as it is lowered into a well. This provides a precise fixed angular offset 68 of substantially 90° between adjacent carrier segments, and thus between adjacent shaped charges such as 14 and 16.

In one particular embodiment of the apparatus of FIGS. 1–4, the carrier 12 is constructed from 11 gauge, cold-rolled steel, ASTM Specification A366. This has a thickness of 0.119 inches and a yield strength in the range of 25,000 to 35,000 psi. The strip is 3.15 inches wide. The slots 52 and 54 extend 1.70 and 1.88 inches, respectively, into the strip from edges 56 and 58, respectively. The longitudinal spacing 62 between slots 52 and 54 is 0.54 inches.

In the embodiment illustrated, the substantially flat elongated strip 24 of structural material is completely flat in that it does not have any protruding flanges or the like. It is within the scope of the present invention, however, to use a substantially flat strip which has rolled edges or short flanges on the edges 56 and 58.

Those skilled in the art will understand that the apparatus 10 shown in FIG. 3 would be connected with other associated commonly available parts to provide a complete perforating gun. For example, a firing head (not shown) will be connected to the upper end 92 of the carrier 12 through use of the slot 94 seen in FIG. 1. This firing head is connected to the wire line (not shown) which lowers the apparatus 10 into the well, and electrical signals are sent through the wire line to the firing head.

The detonating cord 22 seen in FIG. 3 is operable connected to the firing head so that the firing head and detonating cord 22 will cause the shaped charges such as 14, 16, 18 and 20 to be fired in response to an electrical signal transmitted from the ground surface down through the wire line.

As seen in FIG. 1, there is an opening 96 formed in edge 58 of carrier 12, for receiving the detonating cord 22 from the firing head. As is apparent in FIG. 3, the detonating cord 22 wraps around the carrier 12 in a substantially spiral pattern following the arrangement of the shaped charges.

EMBODIMENT OF FIGS. 8–10

Figure 8:
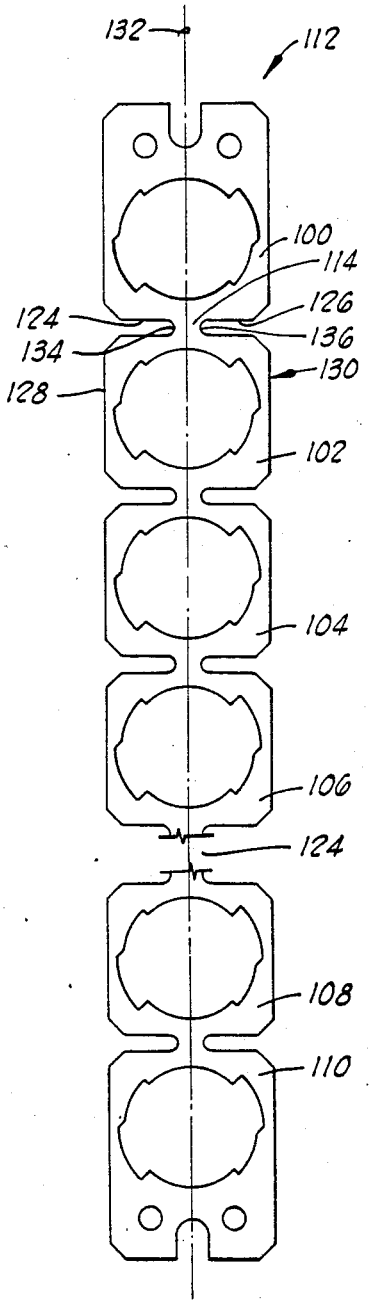
FIG. 8 is an elevation view of an elongated sheet of structural material which has charge receiving openings and transverse slots formed therein for construction of another embodiment of the present invention.
Figure 9:
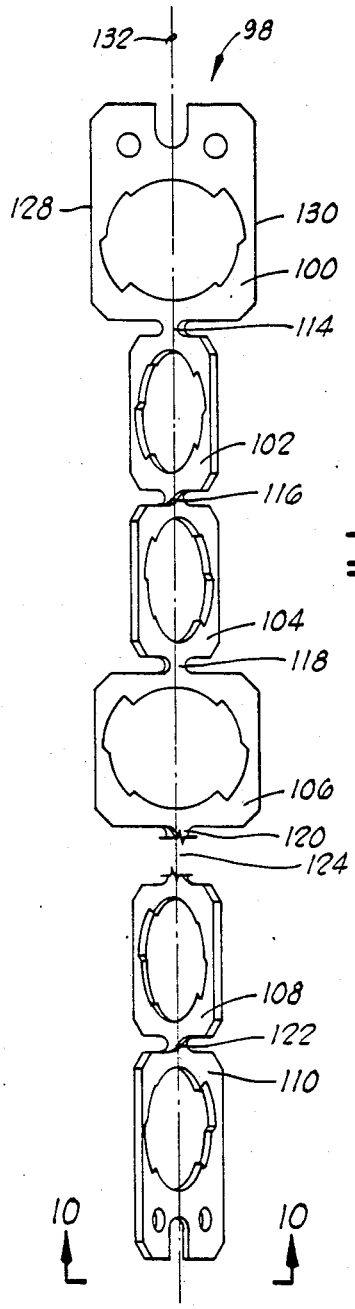
FIG. 9 is an elevation view of a shaped charge carrier formed from the sheet of structural material seen in FIG. 8.
Figure 10:
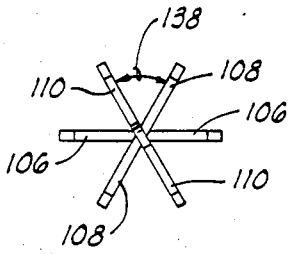
FIG. 10 is a bottom end view of the carrier of FIG. 9.

Referring now to FIGS. 8, 9 and 10, an alternative embodiment of the present invention is there illustrated. FIG. 9 is an elevation view of a carrier 98.

The carrier 98 includes a plurality of carrier segments 100, 102, 104, 106, 108 and 110 integrally formed from a single substantially flat elongated sheet of structural material 112 seen in FIG. 8.

Carrier 98 includes interconnecting portions 114, 116, 118, 120, and 122 between adjacent carrier segments.

A break line 124 indicates that a portion of the carrier 98 is eliminated from FIG. 8 and 9. As previously mentioned, a typical carrier will have a length of approximately ten feet. The spacing between adjacent charges is on the order of two to three inches.

In the embodiment of FIGS. 8–10, each of the interconnecting portions such as 114 is defined at least partially by first and second transverse slots such as 124 and 126, respectively, exending from opposite edges 128 and 130 of carrier 98 toward a longitudinal central axis 132 of carrier 98.

The first and second transverse slots 124 and 126 each terminate at inner ends 134 and 136 short of the longitudinal central axis 132 thus defining the interconnecting portion 114 as a reduced width portion of the sheet 112 located along the longitudinal central axis 132 of carrier 98.

The first and second transverse slots 124 and 126 are substantially aligned with each other and are substantially perpendicular to the longitudinal central axis 132.

The embodiment of FIGS. 8–10 is simpler to construct than the embodiment of FIGS. 1–4 as will be apparent from viewing the drawings. The embodiment of FIGS. 8–10 is preferred when adjacent carrier segments such as 108 and 110 are angularly offset from each other by an angle 138 of substantially less than 90°. In the embodiment illustrated in FIGS. 8–10, the angle 138 is approximately 60°.

Furthermore, the angular offset between adjacent carrier segments such as 108 and 110 is provided by a different type of permanent deformation of the interconnecting portion 122, as compared to the embodiment of FIGS. 1–4. The angular offset between adjacent carrier segments 108 and 110 is provided by deforming the interconnecting portion 122 to place a permanent torsional twist therein about the longitudinal central axis 132 of carrier 98.

THE INTERLOCKING CONNECTION BETWEEN THE SHAPED CHARGES AND THE CARRIER OPENINGS

Figure 5:
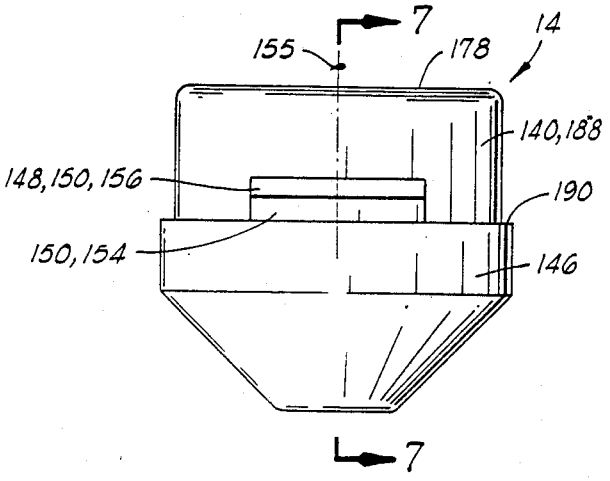
FIG. 5 is a side view of a shaped charge having its forward face pointed upward and its rearward face pointed downward.
Figure 7:
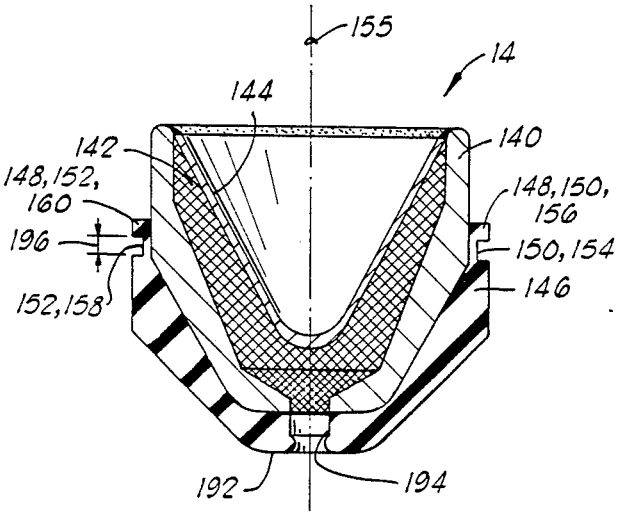
FIG. 7 is a section view of the shaped charge taken along lines 7—7 of FIGS. 5 and 6.
Figure 6:
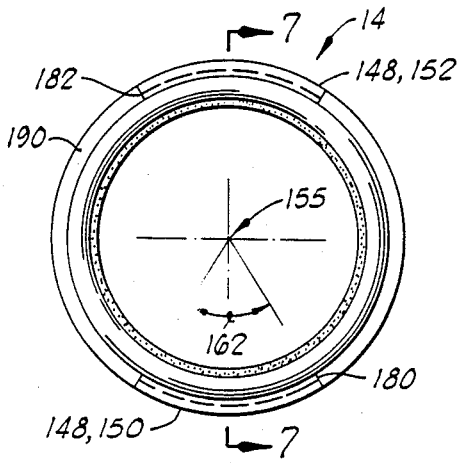
FIG. 6 is a forward end view of the shaped charge of FIG. 5, which can also be described as a top view of the structure as oriented in FIG. 5.

In FIGS. 5–7, the details of construction of one of the shaped charges such as 14 is thereshown.

The shaped charge 14 includes a generally cylindrical outer steel case 140. Within the steel case 140 is located an explosive material 142 and a cone-shaped liner 144 as is well known to those skilled in the art.

The shaped charge 14 includes an elastomeric jacket 146. The jacket 146 is preferably constructed of rubber.

The jacket 146 of shaped charge 14 includes a lug means 148 comprised of first and second lugs 150 and 152.

The lug 150 includes a longitudinal lug portion 154 extending generally parallel to a longitudinal axis 155 of shaped charge 14, and a radial lug portion 156 extending radially outward from the longitudinal lug portion 154.

Similarly, lug 152 includes a longitudinal lug portion 158 and a radial lug portion 160.

As best seen in FIG. 6, each of the lugs 150 and 152 extends through an angle 162 of substantially 60° about the longitudinal central axis 155 of the shaped charge 14.

Referring to the upper portion of FIG. 3, the shaped charge 14 is shown in place within the opening 76 of carrier 12.

The opening 76 is a generally circular opening, and is best shown in FIG. 1. The opening 76 is defined by an irregular shaped inner edge 162 of carrier 12 surrounding the opening 76. The opening 76, as defined by edge 162, includes a minimum diameter portion defined by diametrically opposite arcuate edge portions 162 and 166, each of which circumscribes an angle such as 168 of substantially 60°. The minimum diameter portion of opening 76 defined between opposite edge portions 164 and 166 is too small to longitudinally receive the lug means 148 of rubber jacket 146 of shaped charge 14 therethrough, but the cylindrical steel case 140 of shaped charge 14 can be received between the edge portions 164 and 166.

Opening 76 further includes a lug receiving portion defined by diametrically opposite edge portions 170 and 172, each of which also circumscribes an angle of approximately 60° about the opening 76.

The carrier 12 also includes diametrically opposed wedge means 174 and 176 extending into the opening 76 adjacent the lug receiving portions 170 and 172 of the opening 76 for snugly engaging the longitudinal lug portions 154 and 158 upon rotation of the shaped charge 14 relative to the carrier 12 after longitudinal insertion of the lugs 150 and 152 therethrough.

This can best be understood from the following explanation of the manner in which the shaped charge 14 is assembled with the carrier 12 of FIG. 3.

First, referring to the opening 76 seen in FIG. 1, it is noted that carrier segment 26 has been rotated 90° counterclockwise as viewed from above about the longitudinal central axis 60 to the position seen in FIGS. 2 and 3.

The insertion of shaped charge 14 within opening 76 will be described relative to the full view of the opening 76 seen in FIG. 1, although it will be understood that the shaped charge 14 is not actually inserted into the opening 76 until the flat strip 24 of FIG. 1 has been formed into the carrier 12 seen in FIG. 2 and 3.

With reference to FIG. 1, the shaped charge 14 would be placed with a forward end 178 (see FIG. 5) of steel case 140 facing toward the opening 176, and with the lugs 150 and 152 located immediately in front of the lug receiving portions 170 and 172 of the opening 76. Then, the charge 14 would be longitudinally inserted, that is, parallel to the longitudinal axis 155 of the shaped charge 14, into the opening 76. With reference to FIG. 1, this would be a movement in a direction perpedicular to the plane of FIG. 1 and moving into the plane of the paper upon which FIG. 1 is drawn.

After longitudinal insertion of the shaped charge 14 into the opening 76, the shaped charge 14 is rotated through an angle of 60° clockwise as seen in FIG. 1 about its longitudinal axis 155 so that the longitudinally extending lug portions 154 and 158 engage the wedge means 174 and 176 of carrier 12 to snugly squeeze the longitudinal lug portions 154 and 158 between the wedge means 174 and 176 and the cylindrical steel case 140 of the shaped charge 14 to snugly hold the shaped charge 14 in place. The elastomeric material from which the lugs 150 and 152 are constructed compresses to snugly engage the wedge mans 174 and 176.

It is noted that the rotation of the shaped charge 14 within the opening 76 is limited by engagement of an edge, such as 180 (see FIG. 6), of longitudinal lug portion 154 with a shoulder 184 of the inner edge 162 defining opening 176, which shoulder 184 joins wedge portion 174 to minimum diameter portion 164.

Similarly, an edge 182 (see FIG. 6) of longitudinal lug portion 158 would abut a shoulder 186 (see FIG. 1).

The generally cylindrical steel case of shaped charge 14 has a generally cylindrical outer surface 188 which can be described as a forward generally cylindrical part of a radially outer surface of the shaped charge 14, which is of diameter small enough to be received through the minimum diameter portion 164,166 of opening 76.

The rubber jacket 146 of shaped charge 14 can be described as a rearward enlarged diameter part of shaped charge 14 which is too large to fit through the minimum diameter portion 164,166 of opening 76.

Rubber jacket 146 includes a forward facing annular shoulder 190 which can also be considered to be part of a radially outer surface of the shaped charge 14.

As seen in FIG. 7, a rear end 192 of rubber jacket 146 has a slot shaped opening 194 formed therein through which the detonating cord 22 is received as shown in FIG. 3.

As is apparent in FIG. 3, the thickness of the plate from which the carrier 12 is constructed must be less than a longitudinal distance 196 (see FIG. 7) between the shoulder 190 and the radial lug portions 156 and 160, so that when the shaped charge 14 is in place within the carrier 12, the shoulder 190 is on an opposite side of the carrier 12 from the radial lug portions 156 and 160.

Referring again to FIG. 1, it is noted that the openings 76–86 are not all oriented in the same manner within the sheet 24 of material from which the carrier 12 is formed.

The first two openings 76 and 78 are each oriented in identical fashion as seen in FIG. 1, but the next two openings 82 and 84 are oriented differently. The openings 82 and 84 can be considered to be rotated through an angle of 180° about the longitudinal central axis 60 of the sheet of material 24.

Similarly throughout the length of the sheet of material 24 the orientation of the openings will alternate in pairs.

The reason for this is apparent upon viewing FIG. 3 and considering the desired orientation of each of the charges 14, 16, 18 and 20. As is apparent in FIG. 3, the charges are angularly spaced 90° from each other and thus it takes four charges to form a series which will subsequently repeat along the length of the carrier 12.

For example, even though the carrier segments 26 and 30 lie in substantially the same plane, the charges 14 and 18 assembled therewith face in opposite directions, so it is necessary to have the openings 76 and 80 formed therein in a different manner. The openings are oriented so that when the charge is in place therein, the detonating cord receiving groove 184 in the rear end of the charge will be properly oriented to receive the detonating cord 22 in a substantially spiral wound fashion as is illustrated in FIG. 3.

In the embodiment of FIGS. 8–10, however all of the openings are oriented in an identical fashion as viewed from one side of the strip of material 112 as seen in FIG. 8. The reason for this is that the angular offset between adjacent segments is formed in a very different manner in the embodiment of FIGS. 8–10. As is apparent in FIG. 9, there is a 60° torsional twist placed in each interconecting portion 114–122, and two longitudinally closest segments lying in a common plane such as segments 100 and 106 are actually rotated 180° relative to each other about the longitudinal central axis 132, whereas the segments in the embodiment of FIGS. 1–4 which lie in a common plane are not physically rotated relative to each other even through the openings therein are oriented differently.

Thus it is seen that the apparatus of the present invention readily achieves the ends and advantages mentioned as well as those inherent therein. While certain preferred embodiments of the invention have been illustrated for the purposes of the present disclosure, numerous changes in the arrangement and construction of parts may be made by those skilled in the art which changes are encompassed within the scope and spirit of the present invention as defined by the appended claims.

What is claimed is:

1. A shaped charge carrier assembly apparatus, comprising:

a carrier including:

a plurality of carrier segments integrally formed from a single substantially flat elongated sheet of structural material; an interconnecting portion located between and integrally connected with each two adjacent carrier segments;

said interconnecting portion being defined at least partially by first and second transverse slot extending from opposite edges of said elongated carrier toward a longitudinal central axis of said elongated carrier; and said adjacent carrier segments being angularly offset from each other about said longitudinal axis by permanent deformation of said interconnecting portion located therebetween; and a plurality of shaped charges connected to said plurality of carrier segments.

2. The apparatus of claim 1, wherein:

said first and second transverse slots each terminate short of said longitudinal central axis thus defining said interconnecting portion as a reduced width portion of said sheet located along said longitudinal central axis of said carrier.

3. The apparatus of claim 2, wherein:

said first and second transverse slots are substantially aligned with each other and are substantially perpendicular to said longitudinal central axis of said carrier.

4. The apparatus of claim 2, wherein:

said adjacent carrier segments are angularly offset from each other about said longitudinal central axis by an angle of substantially less than 90°.

5. The apparatus of claim 4, wherein:

said angle is approximately 60°.

6. The apparatus of claim 2, wherein:

said permanent deformation of said interconnecting portion is further characterized as a permanent torsional twist about said longitudinal central axis of said carrier.

7. The apparatus of claim 1, wherein:

said first and second transverse slots are longitudinally spaced from each other;

inner portions of said first and second transverse slots transversely overlap; and wherein said interconnecting portion is defined between said transversely overlapping inner portions of said first and second transverse slots.

8. The apparatus of claim 7, wherein:

said first and second transverse slots both extend past said longitudinal central axis of said carrier so that said interconnecting portion lies along said longitudinal central axis.

9. The apparatus of claim 7, wherein:

said adjacent carrier segments are angularly offset from each other about said longitudinal central axis by an angle of approximately 90°.

10. The apparatus of claim 7, wherein:

said permanent deformation of said interconnecting portion is further characterized as a transverse bend in said interconnecting portion formed about a bending axis substantially parallel to said longitudinal central axis.

11. The apparatus of claim 7, wherein:

each one of said carrier segments includes one and only one charge receiving opening disposed therethrough for receiving one of said shaped charges therein; and a longitudinally closest one of said first and second transverse slots associated with a first interconnecting portion located immediately above an intermediate one of said carrier segments, and a longitudinally closest one of said first and second transverse slots associated with a second interconnecting portion located immediately below said intermediate one of said carrier segments both extend from a common edge of said elongated carrier.

12. The apparatus of claim 1, wherein:

each of said carrier segments is further characterized as being a substantially flat carrier segment;

each of said substantially flat carrier segments includes a charge receiving opening disposed therethrough; and each of said shaped charges is received in one of said charge receiving openings and is firmly held in place therein so that said shaped charge is directed substantially normal to its associated substantially flat carrier segment.

13. A shaped charge carrier assembly apparatus, comprising:

a carrier including:

a plurality of substantially flat carrier segments, each carrier segment having a charge receiving opening disposed therethrough for receiving a shaped charge therein with said charge directed substantially normal to its associated substantially flat carrier segment;

a plurality of rigid interconnecting portions, one of which is located between and integrally formed with each two adjacent carrier segments and each of which is defined between inner ends of first and second transverse slots extending inward from opposite edges of said carrier; and wherein each of said rigid interconnecting portions is permanently deformed and provides a precise fixed angular offset between adjacent carrier segments and thus between adjacent shaped charges; and a plurality of shaped charges, one of which is received in each of said charge receiving openings.

14. A shaped charge carrier assembly apparatus, comprising:

at least one shaped charge including a radially outer surface having:

a forward generally cylindrical part;

a rearward enlarged diameter part;

a forward facing shoulder between said forward part and said rearward part;

lug means extending forwardly from said rearward part continguous to said forward part, said lug means including:

a longitudinal lug portion extending generally parallel to a longitudinal axis of said shaped charge; and a radial lug portion extending outwardly from said longitudinal lug portion longitudinally spaced from said rearward part;

a carrier having a generally circular opening for receiving said shaped charge disposed through a plate, the thickness of which plate being less than the longitudinal distance between said shoulder and said radial lug portion, so that when said charge is in place in said carrier, said shoulder and said lug portion are on opposite sides of said plate, said opening including:

a minimum diameter portion to small to longitudinally receive said lug means therethrough; and a lug receiving portion for longitudinally receiving said lug means therethrough; and wherein said carrier also includes wedge mans, extending into said opening adjacent said lug receiving portion of said opening, for snugly engaging said longitudinal lug portion upon rotation of said shaped charge relative to said carrier after longitudinal insertion of said lug means through said lug receiving portion of said opening.

15. The apparatus of claim 13, wherein;

said first and second transverse slots are longitudinally spaced from each other, and inner portions of said first and second transverse slots transversely overlap, so that said interconnecting portions is defined between said transversely overlapping inner portions of said longitudinally spaced first and second transverse slots.

16. The apparatus of claim 14, wherein said shaped charge includes:

a generally cylindrical outer case upon which said forward generally cylindrical part of said outer surface is defined; and an elastomeric jacket snugly fitted over a rear portion of said case, said elastomeric jacket having defined thereon said rearward enlarged diameter part of said outer surface, said forward facing shoulder, and said lug means.

17. The apparatus of claim 14, wherein:

said lug means includes two diametrically opposed lugs, each having longitudinal and radial lug portions.

18. The apparatus of claim 14, wherein:

said longitudinal lug portion of said lug means is constructed from an elastomeric material so that it can compress to snugly engage said wedge means.

* * * * *